US011613951B2

(12) United States Patent
Kristiansen et al.

(10) Patent No.: US 11,613,951 B2
(45) Date of Patent: Mar. 28, 2023

(54) OR RELATING TO WELL ABANDONMENT AND SLOT RECOVERY

(71) Applicant: Ardyne Holdings Limited, Aberdeen (GB)

(72) Inventors: Lars Kristian Kristiansen, Tananger (NO); Steffen Hansen, Tananger (NO); Steffen Evertsen, Tananger (NO)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 13 days.

(21) Appl. No.: 17/284,445

(22) PCT Filed: Oct. 14, 2019

(86) PCT No.: PCT/GB2019/052913
§ 371 (c)(1),
(2) Date: Apr. 10, 2021

(87) PCT Pub. No.: WO2020/079406
PCT Pub. Date: Apr. 23, 2020

(65) Prior Publication Data

US 2021/0355778 A1 Nov. 18, 2021

(30) Foreign Application Priority Data

Oct. 15, 2018 (GB) ..... 1816731

(51) Int. Cl.
*E21B 29/00* (2006.01)
*E21B 31/20* (2006.01)
*E21B 37/00* (2006.01)

(52) U.S. Cl.
CPC ..... *E21B 29/00* (2013.01); *E21B 31/20* (2013.01); *E21B 37/00* (2013.01)

(58) Field of Classification Search
CPC ..... E21B 29/00; E21B 31/20; E21B 37/00
See application file for complete search history.

(56) References Cited

U.S. PATENT DOCUMENTS 8,365,826 B2 2/2013 Braddick
9,926,758 B1 3/2018 Adkins et al.
(Continued)

FOREIGN PATENT DOCUMENTS

GB 2342666 A 4/2000
WO WO 2013126752 A1 8/2013
(Continued)

OTHER PUBLICATIONS

European Patent Office as International Search Authority; International Search Report and Written Opinion for PCT/GB2019/052913; dated Jan. 22, 2020; all pages; European Patent Office, Rijswijk, The Netherlands.
(Continued)

*Primary Examiner* — Taras P Bemko
(74) *Attorney, Agent, or Firm* — Law Office of Jesse D. Lambert, LLC

(57) ABSTRACT

A method and apparatus for casing recovery in which a clean-up of the inside of the outer casing above the inner casing is performed on the same trip in the wellbore as cutting and pulling a section of the inner casing. A bottom hole assembly including a spear, a casing cutter and at least one clean-up tool is described. An embodiment of a clean-up tool being a jetting sub which can jet fluid radially to wash the outer casing and selectively allow fluid to pass through the sub at different pressures is described. The jetting sub can be used to control operation of other tools in the bottom hole assembly such as the casing cutter and a hydraulic jack.

17 Claims, 4 Drawing Sheets

(56) References Cited

U.S. PATENT DOCUMENTS

Figure 1:
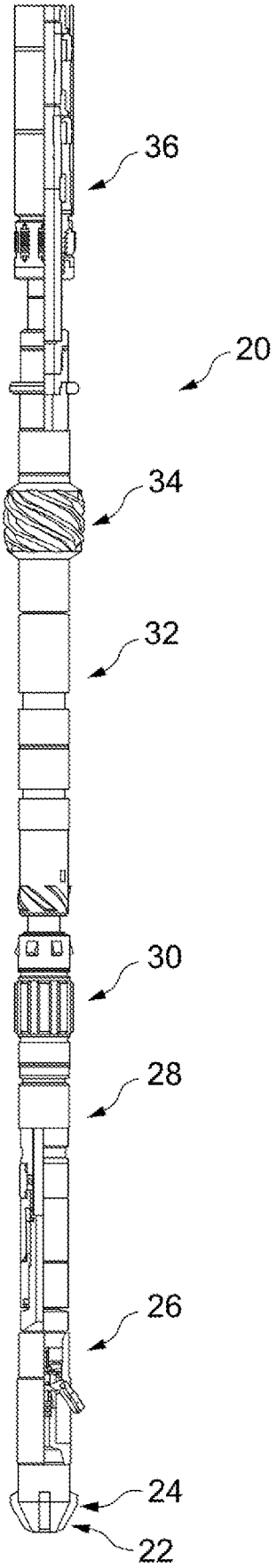

| | | | | |
|---|---|---|---|---|
| 2014/0251616 | A1 | 9/2014 | O'Rourke et al. | |
| 2018/0135372 | A1 | 5/2018 | DeGeare et al. | |
| 2018/0283120 | A1* | 10/2018 | Hart | E21B 21/00 |
| 2019/0048677 | A1* | 2/2019 | Evertsen | E21B 29/002 |
| 2019/0162033 | A1* | 5/2019 | Engevik | E21B 37/02 |
| 2019/0257168 | A1* | 8/2019 | Sunde | E21B 31/20 |
| 2020/0088003 | A1* | 3/2020 | Wardley | E21B 31/005 |
| 2020/0131886 | A1* | 4/2020 | Hora | E21B 23/01 |
| 2020/0224509 | A1* | 7/2020 | Telfer | E21B 31/20 |

FOREIGN PATENT DOCUMENTS

| | | | |
|---|---|---|---|
| WO | WO 2014137914 | A1 | 9/2014 |
| WO | WO 2017046613 | A1 | 3/2017 |
| WO | WO 2017182549 | A1 | 10/2017 |
| WO | WO 2018083473 | A1 | 5/2018 |

OTHER PUBLICATIONS

Intellectual Property Office of the UK Patent Office; Combined Search and Examination Report for GB1816731.2; dated Mar. 25, 2019; all pages; UK Patent Office, Newport, UK.

* cited by examiner

OR RELATING TO WELL ABANDONMENT AND SLOT RECOVERY

The present invention relates to methods and apparatus for well abandonment and slot recovery and in particular, though not exclusively, to a method and apparatus for casing recovery.

When a well has reached the end of its commercial life, the well is abandoned according to strict regulations in order to prevent fluids escaping from the well on a permanent basis. In meeting the regulations it has become good practise to create the cement plug over a predetermined length of the well and to remove the casing. Current techniques to achieve this may require multiple trips into the well, for example: to set a bridge plug to support cement; to create a cement plug in the casing; to cut the casing above the cement plug; and to pull the casing from the well. A further trip can then be made to cement across to the well bore wall. The cement or other suitable plugging material forms a permanent barrier to meet the legislative requirements.

Each trip into a well takes substantial time and consequently significant costs. Combined casing cutting and pulling tools have been developed so that the cutting and pulling can be achieved on a single trip. Such a tool is the TRIDENT® System to Ardyne Technologies Limited, UK.

WO2017046613 describes a cutting and pulling tool which advantageously has a cutting tool which can be operated by rotation of the work string while the pulling tool is anchored to the inside wall of the casing section above the cut to hold the casing in tension and provide stability to the cutting action. The pulling tool may be considered as an anchor or spear.

The casing is cut and pulled in sections to a desired depth and if one can pull long lengths of cut casing from the well this further reduces the number of trips required to achieve casing recovery. However, it is known that the presence of drilling fluid sediments, partial cement, sand, or other settled solids in the annulus between the outside of the casing and the inside of a surrounding outer casing can act as a binding material limiting the ability to free the casing when pulled.

Traditionally, cut casing is pulled by anchoring a casing spear to its upper end and using an elevator/top drive on a drilling rig. However, some drilling rigs have limited pulling capacity, and a substantial amount of power is lost to friction in the drill string between the top drive and the casing spear, leaving insufficient power at the spear to recover the casing. Consequently, further trips must be made into the well to cut the casing into shorter lengths for multi-trip recovery.

To increase the pulling capability, a downhole power tool (DHPT) available from Ardyne Technologies Limited, UK, has been developed. After the casing has been located and engaged with a casing spear, hydraulically-set mechanically releasable slips anchor the DHPT to the wall of the larger outer casing above. A static pressure is applied to begin the upward movement of the cut casing, with the DHPT downhole multi-stage hydraulic actuator functioning as a hydraulic jack. After the stroke is completed, the anchors are released. The power section can be reset and the anchor re-engaged as many times as required. The DHPT is described in U.S. Pat. No. 8,365,826 to the present Applicants, the disclosure of which is incorporated herein in its entirety by reference.

The combination of a cutting and pulling tool with a hydraulic jack is provided in the TITAN® system available from Ardyne Technologies Ltd, UK.

In all cut and pull techniques, as the cut section of casing is removed material within the annulus may be left adhered to the inner surface of the outer casing or be loosened so that it falls onto and into the top of the remaining casing. This material can then cause difficulties: when running in the casing and pulling tool to cut a further section of casing as the casing bore of the inner and/or outer casing may be blocked; material lying on the top of the cut inner casing can prevent casing spears engaging and anchoring correctly to the inner casing preventing it from being successfully pulled; and, material adhering to the inner surface of the outer casing can affect anchoring of a hydraulic jack to the inner surface of the outer casing.

When such difficulties occur or as a precautionary measure, a separate trip is required to perform a clean-up procedure. This uses known clean-up tools such as brushes, scrappers, mills and circulating/jetting subs. The additional trip into the well takes time and consequently causes expense in the well abandonment operation.

It is therefore an object of the present invention to provide a bottom hole assembly for removing casing from a wellbore which obviates or mitigates at least one disadvantage of the prior art.

It is a further object of the present invention to provide a method of removing casing from a wellbore which obviates or mitigates one or more disadvantages of the prior art.

According to a first aspect of the present invention there is provided a bottom hole assembly located on a work string for cutting and removing inner casing located within outer casing from a wellbore, comprising: a spear for casing removal, the spear comprising an anchor mechanism configured to grip a section of the inner casing in the wellbore for removal thereof;

a casing cutter having a cutting mechanism configured to cut the inner casing; and at least one first clean-up tool configured to remove material from inside the outer casing above the inner casing.

In this way, the first clean-up tool can clear material which may be left following the removal of a previous section of the inner casing, so that the next section of casing can be cut and removed on a single trip without the requirement of a separate cleaning trip.

Inner casing is considered to be any casing or tubular which has a smaller diameter than the casing or tubular through which you are accessing it. In this way, the invention can be used to recover casing which is below a casing shoe in open hole, where the bottom hole assembly is run-in larger diameter casing above the casing shoe.

Preferably, the at least one first clean-up tool is a mill, the mill comprising a cylindrical body with an abrasive outer surface with an outer diameter matching an inner diameter of the outer casing. In this way, the material adhering to the inner surface of the outer casing is removed. More preferably, the mill includes an abrasive surface on a first end of the cylindrical body configured to mill a top of the inner casing. In this way, the top of the previous cut section of inner casing is cleaned in preparation for engagement with the casing spear.

Preferably, there is a second clean-up tool at a first end of the bottom hole assembly configured to remove material from inside the inner casing. In this way, the inner casing can be cleaned on run-in also. More preferably, the second clean-up tool is a taper mill.

In an embodiment, the bottom hole assembly comprises, in order from the first end, a second clean-up tool, a cutter mechanism, a spear and a first clean-up tool.

The at least one first clean-up tool may be a jetting tool which circulates fluid out through one or more ports from a central bore, in a radial direction to wash an inner surface of the outer casing. More preferably, the jetting tool can operate in three configurations: on run-in, fluid passes down the central bore and radially out of the ports; on activation, fluid is prevented from passing through the central bore and out of the ports; and on deactivation, fluid can pass through the central bore and is prevented from passing out of the ports.

In this way, the jetting tool can be used to control other fluid pressure operated tools in the work string.

The bottom hole assembly may include a hydraulic jack.

In an embodiment, the bottom hole assembly comprises, in order from the first end, a taper mill, a cutter mechanism, a spear, a jetting tool, a mill and a hydraulic jack.

The work string may be drill pipe or coiled tubing. Preferably the work string has a central throughbore so that fluid can be pumped from surface to the bottom hole assembly.

The bottom hole assembly may include sections of drill pipe known as drill collars so that the mechanisms and clean-up tools can be spaced out along the assembly at desired separations from each other. In this way, the length of the section of inner casing to be initially cut can be selected and the cutting mechanism spaced out from wider diameter tools used in the outer casing.

The jetting tool may be a jetting sub, circulation sub and/or a valve. Preferably the jetting tool comprises:

a cylindrical outer body in which is located a mandrel, the mandrel having a first end arranged towards a first end of the outer body and a second extending from a second end of the outer body;

the first end of the outer body and the second end of the mandrel being configured for connection to drill pipe in a work string;

the mandrel being moveable within the outer body against a bias between a first position in which a first fluid flow path exists from the first end of the outer body to the second end of the mandrel through a central bore of the mandrel, and a second position in which flow through the central bore of the mandrel is prevented; wherein the outer body includes at least one radial port arranged through the outer body; and an obturating member is arranged within the outer body, the obturating member being moveable from an initial position in which a second fluid path exists from the first end of the outer body to an outer surface of the outer body via the at least one radial port, to a final position in which flow through the at least one radial port is prevented, and wherein the obturating member is moved from the initial position to the final position against the bias.

In this way, the jetting tool can operate in three configurations: on run-in, fluid passes down the central bore and radially out of the ports; on activation, fluid is prevented from passing through the central bore and out of the ports; and on deactivation, fluid can pass through the central bore and is prevented from passing out of the ports.

Preferably, the bias is a spring arranged between a lip on the inner surface of the outer body towards the second end of the outer body and a lip on the outer surface of the mandrel towards the first end of the mandrel. In this way, the mandrel is biased towards the first end of the outer body.

Preferably, movement against the bias is provided by applying tension to the work string in which the jetting tool in located. Such tension is applied when the second end of the mandrel is held in position. This may be by anchoring the work string to casing below the jetting tool. The spring is compressed under the applied tension as the lip on the outer body is moved towards the lip on the mandrel.

Preferably, the mandrel includes a plug at the first end blocking the central bore, the plug having a sealing surface to contact a seat on an inner surface of the outer body. In this way, when the plug is seated flow through the jetting tool is prevented. Preferably, there are a plurality of apertures arranged through the mandrel at the first end adjacent the plug. These apertures provide a pathway for fluid to enter the central bore when the plug is not seated in the outer body.

Preferably, the obturating member comprises a cylindrical body including one or more openings which when aligned with the at least one radial port allow fluid to pass to the outer surface of the outer body; a first latching mechanism at a first end to hold the obturating member against the outer body in the initial position until tension is applied; a second latching mechanism at a second end to hold the obturating member against the mandrel when tension is applied to move the obturating member from the initial position to the final position.

Preferably, there is a chamber between the second end of the obturating member and the outer body which is accessible via a relief port to the outer surface of the outer body. In this way, by inputting fluid to the chamber the obturating member can be moved back to the initial position and latched to the outer body and mandrel again. This reset will typically be done when the jetting tool is returned to surface.

According to a second aspect of the present invention there is provided a method of removing inner casing located within outer casing from a wellbore in a single trip, comprising the steps:

(a) arranging a bottom hole assembly according to the first aspect on a work string;
(b) running the work string in the well bore while operating at least one first clean-up tool on the work string;
(c) removing material from inside the outer casing above the inner casing;
(d) operating the cutting mechanism to cut a section of the inner casing;
(e) gripping the section of the inner casing with the anchor mechanism; and
(f) by raising the work string, removing the section of the inner casing from the wellbore.

In this way, a separate clean-up trip into the wellbore is avoided with the wellbore being advantageously cleaned when the cutting and pulling trip is made.

Step (c) may comprise one or more steps from the group comprising: rotating a mill and abrading material on an inner surface of the outer casing; rotating a mill and abrading material at a top of the inner casing; and jetting fluid radially from ports in the work string to wash an inner surface of the outer casing.

The method may include rotating a mill and abrading material within the inner casing.

The method may include jacking the section of the inner casing during step (f). In this way, additional force is available to release a potentially stuck cut section of inner casing.

The method may include gripping the inner casing with the anchor mechanism during step (d). In this way, inner casing can be held in tension during the cut.

The method may include applying tension to the work string from surface to operate one or more of the mechanisms and clean-up tools in the bottom hole assembly.

The method may include pumping fluid down a throughbore of the work string from surface to operate one or more of the mechanisms and clean-up tools in the bottom hole assembly.

Preferably, the method includes the steps of:

(i) inserting a jetting tool in the bottom hole assembly;

(ii) on run-in, pumping fluid through a central bore of the jetting tool and radially out of ports to wash the inner surface of the outer casing;

(iii) activating the jetting tool by applying tension to the work string to prevent fluid from passing through the central bore and out of the ports; and (iv) deactivating the jetting tool by releasing tension on the work string to allow fluid to pass through the central bore and prevent fluid from passing out of the ports.

In this way, the jetting tool can be used to control the operation mechanisms and other clean-up tools in the bottom hole assembly.

Preferably, fluid passing through the tool at step (ii) is at a first pressure used to operate a second clean-up tool being a taper mill at a first end of the bottom hole assembly.

Preferably, fluid passing through the tool at step (iv) is increased to a second pressure to operate the cutting mechanism. More preferably, cutting blades of the cutting mechanism are actuated to extend and cut at the second pressure, higher than the first pressure. This ensures that the cutter mechanism does not attempt to cut casing during run-in.

Fluid passing through the tool may be used to operate a downhole motor located above the cutting mechanism. In this way, the bottom hole assembly above the downhole motor can be anchored to casing while the cutting mechanism and, if desired, the second clean-up tool is operated.

Preferably, the jetting tool can cycle between steps (iii) and (iv).

Preferably, a hydraulic jack is operated by applying tension to the work string and activating the jetting tool. In this way, with the hydraulic jack located above the jetting tool pressure can be increased in the hydraulic jack to cause it to operate and pull the cut section of inner casing.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Figures 2A, 2B, 2C, 2D, 2E, 2F:
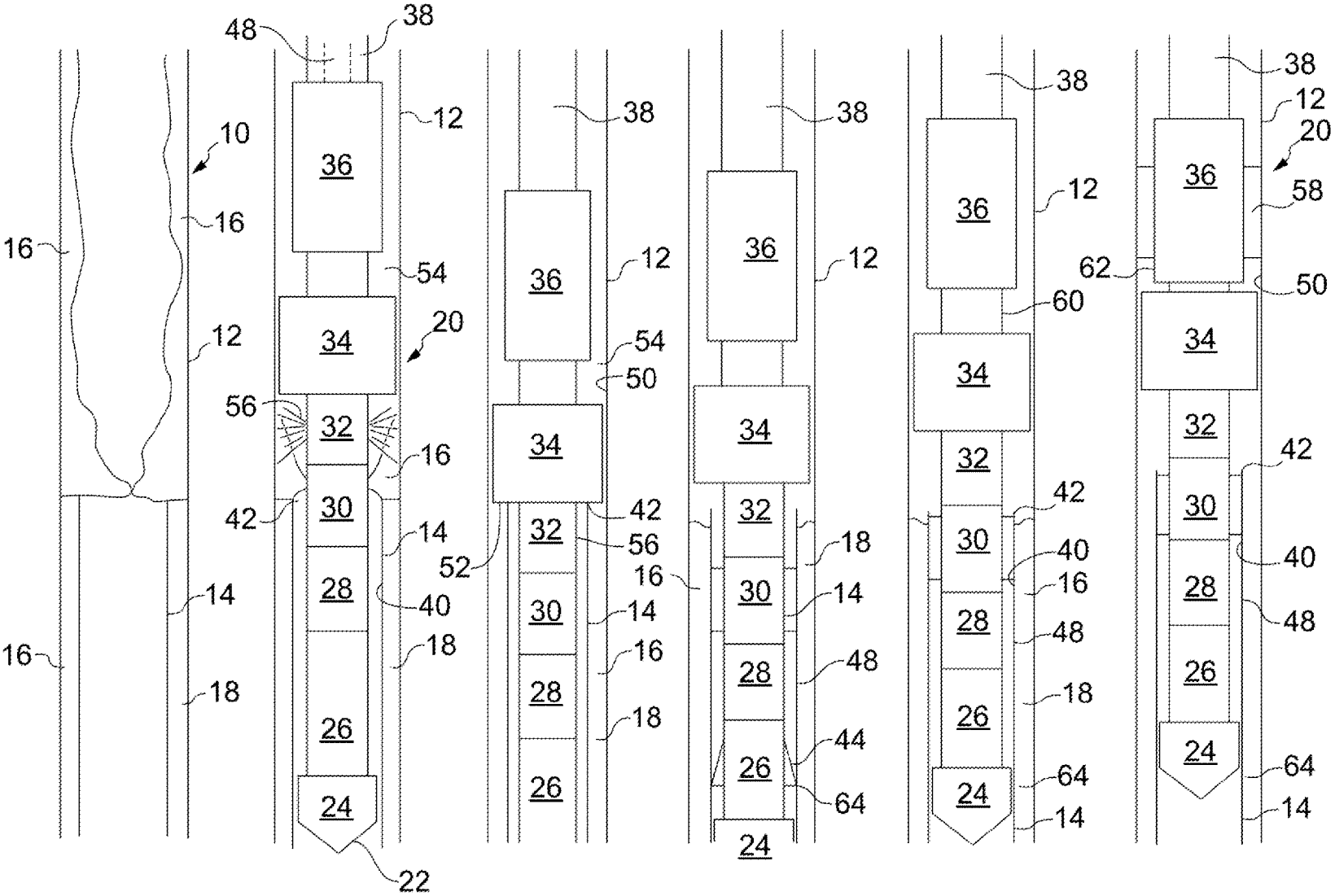
Figure 3A:
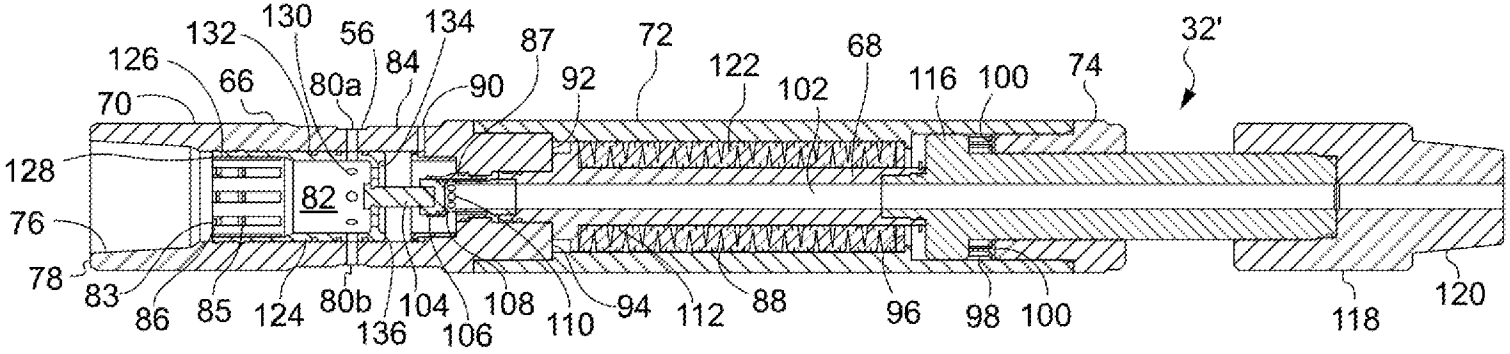
Figure 3B:
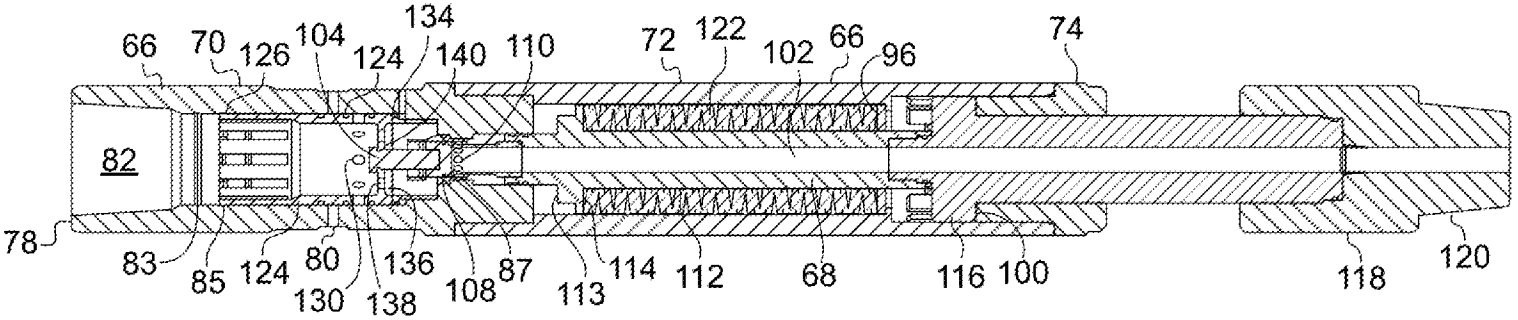
Figure 3C:
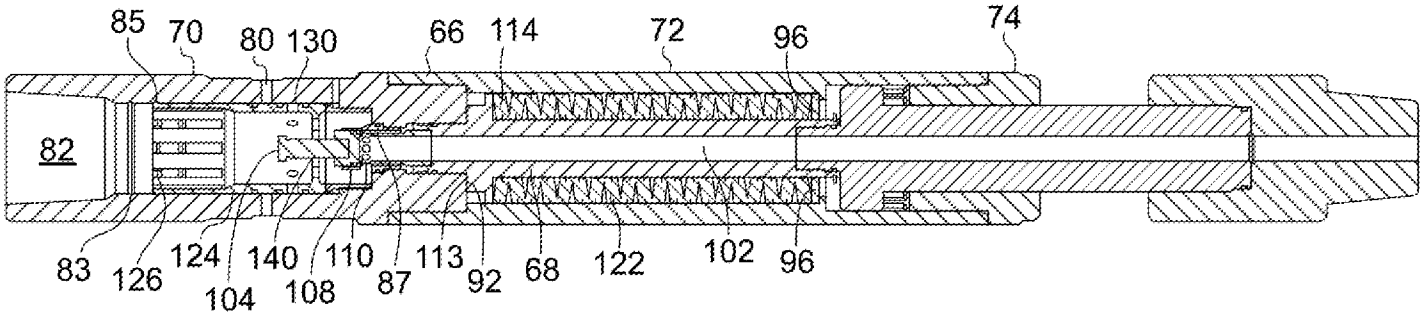
Figure 3D:
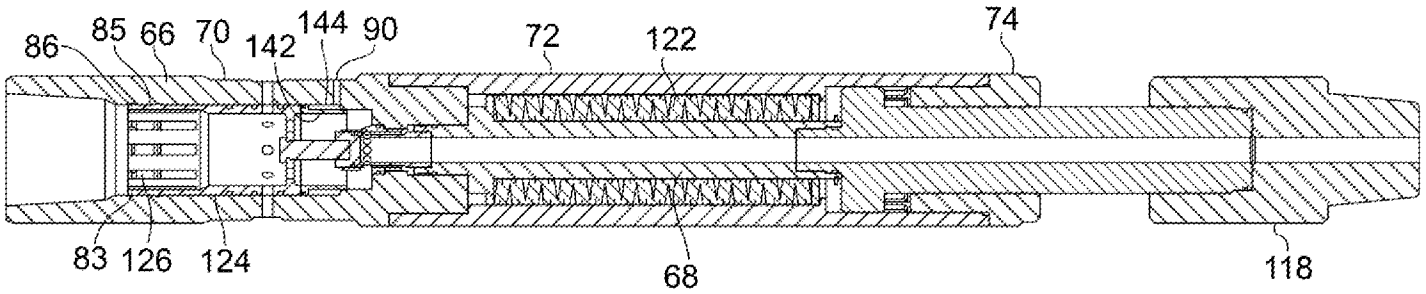

Embodiments of the present invention will now be described, by way of example only, with reference to the accompanying drawings of which:

FIG. 1 is an illustration of a bottom hole assembly according to an embodiment of the present invention;

FIGS. 2(*a*) to 2(*f*) illustrate a method, carried out on a single trip in a well bore, according to a further embodiment of the present invention; and FIGS. 3(*a*) to 3(*d*) are schematic illustrations of a third clean-up tool in (a) run-in, (b) activation, (c) deactivation, and (d) reset positions for use in a bottom hole assembly according to a further embodiment of the present invention.

Reference is initially made to FIG. 2(*a*) of the drawings which illustrates a method of recovering casing from a well, according to an embodiment of the present invention. In FIG. 2(*a*) there is shown a cased wellbore, generally indicated by reference numeral 10, having an outer casing 12 and an inner casing 14. In an embodiment, length of casing 12 is 9⅝" diameter while the outer casing is 13⅜" diameter. A section of the inner casing has been removed and, as a result, material 16 being typically drilling fluid sediments, partial cement, sand, or other settled solids in the annulus 18 between the outside of the inner casing 14 and the inside of a surrounding outer casing 12 is left in the wellbore 10. This material 16 can cause problems in running in a tool string to cut and remove a further section of the inner casing 14.

To remove the material 16 within the outer casing 12 above the inner casing 14 and then cut and pull a section of the inner casing 14 on a single trip is achieved using a bottom hole assembly, generally indicated by reference numeral 20, according to an embodiment of the present invention being run into the wellbore 10. A bottom hole assembly 20 is shown in FIG. 1.

Bottom hole assembly 20 comprises a cutter mechanism 26, a casing spear 30 and a clean-up tool, being mill 34. In the embodiment of FIG. 1, bottom hole assembly 20 comprises further parts which provide, in order from a first end 22, a taper mill 24, a cutter mechanism 26, a drilling motor 28, a casing spear 30, a jetting tool 32, a mill 34 and a hydraulic jack 36. The further parts are optional either alone or in combination with other parts. Adjacent parts may be formed integrally on a single tool body or may be constructed separately and joined together by box and pin sections as is known in the art. Two or more parts may also be integrally formed and joined to any other part. Further parts may be included and drill pipe sections can be inserted between parts to provide a desired spaced apart relationship between the component parts. The bottom hole assembly 20 is run on a work string 38 (see FIG. 2(*b*)).

The work string 38 is a drill string typically run from a rig (not shown) via a top drive/elevator system which can raise and lower the string 38 in the wellbore 10.

Casing spear 30 operates to grip the inner surface 40 of the inner casing 14. The casing spear 30 anchors as a slip designed to ride up a wedge and by virtue of wickers or teeth on its outer surface grip and anchor to the inner surface 40 of the inner casing 14. The casing spear 30 includes a switch which allows the casing spear to be inserted into the casing 14 and hold the slips in a disengaged position until such time as the grip is required. At this time, the casing spear 30 is withdrawn from the end 42 of the casing 14 and, as the switch exits the casing 14, it automatically operates the slips which are still within the casing 14 at the upper end 42 thereof. This provides the ideal setting position of the spear 30. In a preferred embodiment the casing spear 30 is the TYPHOON® Flow Release Mechanism (FRM) Spear as provided by the Ardyne AS. The FRM Spear is described in WO2017/182549, the disclosure of which is incorporated herein in its entirety by reference.

Cutting mechanism 26 is a standard fluid pressure operated casing cutter. These casing cutters have a number of blades 44, typically three, which are held inside the body of the cutting mechanism 26 as it is run in the wellbore 10. When cutting is required, fluid is pumped through a bore 48 of the string 38 from surface through the bottom hole assembly 20 and when sufficient fluid pressure is reached in the cutting mechanism, pistons are displaced which extend the pivoted blades 44 outwards from the body to contact the inner casing 14. By rotating the cutter mechanism 26, either by rotation of the work string 38 at surface or by use of a downhole motor 28 located above the cutting mechanism 26, the blades will cut the inner casing 14 and produce a section of cut casing 48. In the embodiment shown there is a downhole motor 28. Downhole motor 28 is a positive displacement motor configured to convert hydraulic force of a pumped fluid through the work string 38 into a mechanical force to rotate the cutting mechanism 26.

The clean-up tool mounted above the casing spear 30 and cutting mechanism 26 is a mill 34. Mill 34 has a cylindrical body with an outer surface having a tungsten carbide cutting structure providing an abrading surface. The body has an outer diameter sized to fit within the outer casing 12. In this way, when the work string 38 is rotated, the mill 34 will rotate and cutting structure will mill and grind material 16 adhering to the inner surface 50 of the outer casing 12. Additionally, a lower end 52 of the mill 34 also includes an abrading surface. Material 16 contacting the lower end 52 will also milled and ground. In particular, the lower end 52 can contact the upper end 42 of casing 14 effectively removing all material 16 which may have settled or adhered to the cut surface of the inner casing 14. Such cleaning will ensure that the switching mechanism of the casing spear 30 or other tools operated by contacting an end of the casing 14, will perform correctly.

Alternative and/or additional clean-up tools may be used. For example, brushes and or scrappers may be mounted on a body in the work string 38. A fluid jetting tool 32 may also be used as the clean-up tool. These tools divert all or part of the fluid flowing in the bore 46 out of the tool through ports or nozzles 56. The fluid impacts the inner surface 50 as it travels at high velocity and thus dislodges material 16 which is then circulated up the annulus 54 between the work string 38 and the outer casing 12. A preferred embodiment of a fluid jetting tool 32 is described herein after with reference to FIG. 3(*a*) to (*d*). It is preferable not to use wipers as these provide a seal across the annulus 54. The seal would prevent circulation and cuttings removal when the cutting mechanism 26 is operated.

A further clean-up tool in the form of a taper mill 24 can be used. The taper mill 24 has a pilot and an abrasive surface. It is rotated in use. Taper mill 24 will bore through any material 16 within the inner casing 14 as the bottom hole assembly 20 is run-in. Advantageously, the outer diameter of the taper mill 24 matches the diameter of the inner casing 14 and thus will mill and grind any material 16 which is within the casing 14. This will clean the inner surface 40 of the inner casing 14 to assist in the attachment of the casing spear 30. Additionally, the jetting tool 32 could also be run into the inner casing 14. The outer diameter of the jetting tool 32 can be selected for the minimum casing diameter size it will be run-in.

Additional section of drill pipe, typically drill collars, will be located between the parts so that the cutting mechanism 26 can be positioned at a desired cutting depth, say 100 to 200 m inside the inner casing 14 with the wider diameter tools, such as the mill 34, remaining above the inner casing 14.

There will also be material 16 in the annulus 18 which can prevent the cut section of casing 14 from being free to be pulled from the wellbore 10. It is therefore preferable to include a hydraulic jack 36 in the bottom hole assembly 20. The hydraulic jack 36 has a resettable anchor 58 to allow the jack to be fixed to the inner surface 50 of the outer casing 12 and an actuator system which pulls an inner mandrel 60 up into a housing 62 of the jack 36. In a preferred embodiment the hydraulic jack is the DHPT available from Ardyne AS. It is described in U.S. Pat. No. 8,365,826 to TIW Corporation, the disclosure of which is incorporated herein in its entirety by reference. The remaining parts of the bottom hole assembly 20 are connected on the mandrel 60, so that upon actuation via increasing fluid pressure inside the housing 62, a series of stacked piston moves to pull the mandrel 60, remaining parts of the bottom hole assembly 20 and the cut section of casing 48 upwards. This will free the cut section of casing 48. Once the inner mandrel 60 is raised, the anchor 58 is unset and the jack 36 moved higher in the casing 12 with the housing 62 moving relative to the mandrel 60 and thereby exposing the mandrel 60. The anchor 58 is reset and the next pull can be made. These steps can be repeated until the cut section of casing 48 is entirely free and then the work string 38 with the bottom hole assembly 20 and the cut section of casing 48, attached via the casing spear 30, is pulled and removed from the wellbore 10.

Reference is now made to FIG. 2(*b*) to (*f*) which show the steps of removing a section of inner casing 14 from the wellbore 10 of FIG. 2(*a*) according to an embodiment of the present invention. Like parts to those of FIG. 1 have been given the same reference numeral to aid clarity.

FIG. 2(*b*) shows a bottom hole assembly 20 lowered into the casing 12 on the work string 38. As the assembly 20 is run in, the work string 38 is rotated and fluid will be circulated through the bore 46 and the assembly 20 and circulated up the annulus 54 to surface. The taper mill 24 clears a route through the material 16 and enters the inner casing 14 cleaning it. The jetting tool 32 will be jetting fluid through nozzles 56 to wash away the material 16. Additionally, the mill 34 will be grinding any material 16 adhering to the inner surface 50 of the outer casing 12. As can be seen, all the material is removed in the annulus 54 above the mill 34. Material 16 is therefore removed from the inside of the outer casing 12 above the inner casing 14. At this time fluid pressure through the bottom hole assembly 20 is kept sufficiently low so that the cutting mechanism 26 is not actuated and the blades 44 remain retracted.

FIG. 2(*c*) shows the mill 34 reaching the end 42 of casing 14. Any material settled on the end 42 is milled away and the cut surface dressed ready to operate the switch on the casing spear 30 when required. During this milling stage the jetting sub 32 is cleaning the inner surface 40 of the inner casing 14. The work string 38 is then raised to position the blades 44 of the cutting mechanism 26 at the desired cut position 64. Fluid pressure is increased sufficiently to actuate the blades 44 and via rotation of the motor 28, the inner casing 14 is cut in a circumferential slot to sever a cut section of casing 48 from the inner casing 14. This is shown in FIG. 2(*d*). The spear 30 and/or the jack 36 may be anchored to casing 12, 14 respectively, to hold the casing 14 in tension when the cut is made by the downhole motor 28 turning the cutting mechanism 26.

The fluid pressure is decreased to retract the cutting blades 44. The work string 38 is raised so that the casing spear 30 exits the upper end 42 of the cut section of casing 48, thereby switching the spear to anchor to the inner surface 40 at the upper end 42, as shown in FIG. 2(*e*).

The work string 38 is raised to see if the cut section of casing 48 is free. If so, continual pulling will remove the work string 38, bottom hole assembly 20 and the cut section of casing 48. If the cut section of casing 48 is stuck the hydraulic jack is activated. In this embodiment, the bore 46 is sealed below the jack 36 so that fluid pressure in the jack 36 can be increased. The increased fluid pressure initially sets the anchor 58 to the inner surface 50 of the outer casing 12. Continued pumping then raises the mandrel 60 with an increased force supplied via the stacked pistons. This is as illustrated in FIG. 2(*f*). The anchor 58 can then be unset and the work string 38 pulled to raise the housing 62. At the point of full extension of the mandrel 60 from the housing 62, the cut section of casing 48 will be pulled on the work string 38 to see if it is free. If so the work string 38 is pulled out of the wellbore 10 to recover the cut section of casing. If the cut section of casing 48 is stuck, the jack 36 is operated again at the higher position to jack the cut section of casing 48 again and the steps repeated until the cut section of casing 48 is free and can be pulled to the surface by the work string 38 via attachment to the casing spear 30. The wellbore will now resemble FIG. 2(*a*) ready for a further section of casing to be removed.

When retrieved the bottom hole assembly 20, can be redressed and run again, any number of times until a sufficient length of casing 14 has been removed for a cement plug meeting legislative requirements in well abandonment to be deposited above the remaining inner casing 14.

By providing a clean-up tool on the same work string, the clean-up operation together with the cutting and pulling operation may be performed in a single downhole trip.

Reference is now made to FIG. 3(*a*) of the drawings which illustrates a clean-up tool in the form of a jetting sub 32'. Jetting sub 32' is designed to both clean the casing 12, 14 and control fluid pressure in the bore 46 so that the blades 44 of the cutting mechanism 26 are not actuated when fluid is pumped through the work string 38 to operate other components. By use of the jetting sub 32', the bottom hole assembly 20 of FIG. 1 can be operated using only full rotation and reciprocal movement of the work string 38 and fluid pumped through the bore 46.

The sub 32' includes an outer housing 66 and a mandrel 68 telescopic relative to the first outer housing 66, which can be moved axially in the outer housing 66 against the bias of a spring 122 in order thereby to control the flow of fluid through and out of the sub 32'.

The cylindrical outer housing 66 comprises three sections: a top piece 70, middle section 72 and bottom piece 74. The top piece includes a box section 76 at a first end 78 for connection into the work string 38 or to another part of the bottom hole assembly 20; a latch profile 86 comprising an upper circumferential groove 83 and a lower circumferential groove 85 on an inner surface 88; eight radial ports (only two shown) 80*a,b* being apertures equidistantly spaced around the piece 70 between a bore 82 and an outer surface 84 of the outer housing 66; a relief port 90; a circumferential sealing seat 87 in the bore 82; and a stop 92 at a second end 94. The middle section 72 threaded to the top piece has a ledge 96 forming a lip or stop on the inner surface 88. The bottom piece 74 threaded to the middle section 72 has a series of splined grooves 98 around the inner surface 88 which terminate at a stop 100 facing the first end 78.

Mandrel 68 has a central bore 102 with a T-shaped plug 104 extending from and blocking a first end 106; an outer profiled portion 108 shaped to mate in the seat 87 and seal against it; eight apertures (five shown) 110 equidistantly spaced around the mandrel 68 between the bore 102 and an outer surface 112 of the mandrel 68; a stop 113; a ledge 114 forming a lip or stop on the outer surface 112; a piston 116 disposed on the outer surface 112, which has longitudinally arranged splines (not shown) around its body; and a lower connector 118 which includes a pin section 120 for connection into the work string 38 or to another part of the bottom hole assembly 20.

Within the top piece 70 there is an obturating member 124, being a cylindrical body having: latches in the form of collet dogs 126 at a first end 128; eight radial ports (five shown) 130 being apertures equidistantly spaced around the member 124 between the bore 82 and an outer surface 132 of the member 124; and an end plate 134 at a second end 136 having four apertures (two shown) 138*a,b* arranged around the end plate 134 to provide a passageway therethrough and a central aperture 140.

When assembled, as shown in FIG. 3(*a*) to be run-in, the mandrel 68 is located within the outer housing 66 and extending therefrom at the bottom piece 74 with the lower connector 118 attached. The spring 122 is arranged between the ledges 96, 114 and is in an expanded configuration to urge the mandrel 68 towards the first end 78 of the outer housing 66. The mandrel 68 is prevented from movement in that direction by contact of the stops 92, 113. The apertures 110 are above the sealing seat 87 so that the profiled portion 108 is not in the seat 87. The plug 104 is slid through the central aperture 140 of the obturating member 124 and the T shaped head of the plug 104 cannot pass through the central aperture 104 and is held against the end plate 134. The splines of the piston 116 are in the splined grooves 98 of the outer housing 66 preventing relative rotation between the mandrel 68 and the outer housing 66. The obturating member 124 is positioned such that the dogs 126 are in the upper groove 83 of the latch profile 86 acting as a collet and the radial ports 130 are aligned with the radial ports 80 in the outer housing 66.

In this configuration, fluid entering the sub 32' through the bore 82 at the first end 78 of the outer housing 66, passes into the obturating member 124 and a portion can exit the sub 32' via the radial ports 80, 130 to wash casing 12, 14 in which the sub 32' is located. These ports 80, 130 therefore act as nozzles 56 and can be shaped for the purpose. Fluid also passes through the sub 32' via a path from the bore 82, through apertures 138 in the end plate 134 of the obturating member 124, around the plug 104 and into apertures 110 on the mandrel 68 to the central bore 102 to exit at the lower connector 118. As fluid is ejected from the sub 132' through the ports 80, 130, fluid pressure in the work string 38 below the sub 32' is lower than that above the sub 32' and consequently is too low to actuate the blades 44 of the cutting mechanism 26 arranged below the sub 32'. This configuration is maintained in steps shown in FIGS. 2(*b*) and 2(*c*).

When the sub 32' is located in the wellbore 10 and washing is complete, the washing feature can be switched off. This is achieved by fixing the lower connector 118 and mandrel 68 in position in the wellbore 10. With the casing spear 30 anchored to the inner casing 14 (FIG. 2(*d*)) the lower connector 118 is held in place. Tension applied to the work string 38 at surface will pull the outer housing 66 upwards relative to the fixed mandrel 68. Ledges 96, 114 are brought towards each other to overcome the bias of the spring 122. The piston 116 meets the stop 100. The sealing seat 87 is moved upwards and meets the profiled portion 108 creating a seal with the apertures 110 now arranged below the sealing seat 87. The obturating member 124 cannot move as it is held in place by the T shaped plug 104 connected to the mandrel 68. Consequently, movement of the outer housing 66 causes the dogs 126 to be released from the upper groove 83 of the latch profile 86 and move to the lower groove 85 of the latch profile 86 which misaligns the radial ports 80, 130. This is as illustrated in FIG. 3(*b*) as an activation position.

In the activated configuration there is no fluid flow out of the sub 32' to the annulus 54 as the obturating member 124 now covers the radial ports 80. There is also no fluid through the sub 32' as the profiled portion 108 is in the sealing seat 87. In sub 32' now acts as plug in the bore 46 and fluid above the sub 32' will increase in pressure.

To obtain flow through the sub 32' we must move to the deactivated position in FIG. 3(*b*). This is achieved by releasing tension on the work string 38 or by releasing the anchor of the casing spear 30 so that the mandrel is not fixed. It is preferable to release the tension without releasing the anchor of the casing spear 30. When tension is released, the spring 122 biases the ledges 96, 114 apart by expansion of the spring 122 and the outer housing 66 moves downwards relative to the still fixed mandrel 68 until the stops 92, 113 meet again. The profile portion 108 moves off the sealing seat 87 and thereby brings the apertures 110 back above the seat 87. Notably, the plug 104 has travelled through the central aperture 140 as the dogs 126 of the obturating member 124 remain in the lower groove 85 of the latch profile 86. This means that the obturating member 124 has moved with the outer housing 66 such that the radial ports 80, 130 remain misaligned.

In this configuration, flow is now entirely through the sub 32' via the bores 82, 102. There is now a higher fluid pressure below the sub 32' than in the activated configuration and this will be sufficient to operate the cutting mechanism and actuate the blades 44 for cutting the casing 14.

By applying and releasing tension on the work string 38, the sub 32' can cycle between the activated and deactivated configurations. In the method step as shown at FIG. 2(*d*), the sub 32' is activated to stop the cutting mechanism 26 and retract the blades 44 for repositioning of the casing spear 30. The sub 32' remains in the activated configuration for the step shown in FIG. 2(*f*) as pressure build-up in the bore 46 above the sub 32' is used to operate the hydraulic jack 36.

When the cut section of casing 48 is recovered to surface, the sub 32' can be reset by pressurizing up through the relief port 90 to move the obturating member 124 so that the dogs 126 are released from the lower groove 85 and locate in the upper groove 83 of the latch profile 86. This is achieved by there being an additional internal sleeve 142 below the member 124 which is arranged to create a chamber 144 accessible by the relief port 90. Movement of the sleeve 142 under expansion of the chamber 144 causes the sleeve 142 to abut the obturating member 124 and cause it to be moved towards the first end 78 of the The principle advantage of the present invention is that it provides a bottom hole assembly for use in the recovery of casing in a wellbore which performs a clean-up of the wellbore on the same trip as recovering the casing.

A further advantage of the present invention is that it provides a method of recovering casing from a wellbore in which a clean-up step is performed on the same trip as cutting and pulling the casing.

It is a further advantage of at least one embodiment of the present invention is that it provides a bottom hole assembly including a jetting sub which can also control pressures in the assembly to prevent the cutter being deployed until it is at the correct cutting position.

Modifications may be made to the invention herein described without departing from the scope thereof. For example, the cutting mechanism may be operated by other means than fluid pressure in the bore such as be tension and/or incorporation of fluid control lines. Although the above description refers to removing casing diameters of 9⅝ inches and 13⅜ inches, the method and apparatus may be used with other casing diameters. Seals may also be present between moving parts and around apertures/ports in the jetting tool.

We claim:

1. A bottom hole assembly located on a work string for cutting and recovering inner casing located within outer casing from a wellbore, comprising, in order from a first end:

a taper mill, a casing cutter having a cutting mechanism configured to cut the inner casing;

a spear for casing removal, the spear comprising an anchor mechanism configured to grip a section of the inner casing in the wellbore for removal thereof; and at least one first clean-up tool configured to remove material from inside the outer casing above the inner casing, wherein the at least one first clean-up tool is a mill, the mill comprising a cylindrical body with an abrasive outer surface with an outer diameter matching an inner diameter of the outer casing.

2. A bottom hole assembly according to claim 1 wherein the mill includes an abrasive surface on a first end of the cylindrical body configured to mill a top of the inner casing.

3. A bottom hole assembly according to claim 1 wherein a further first clean-up tool is a jetting tool which circulates fluid out through one or more ports from a central bore, in a radial direction to wash an inner surface of the outer casing.

4. A bottom hole assembly according to claim 3 wherein the jetting tool operates in three configurations: on run-in, fluid passes down the central bore and radially out of the ports; on activation, fluid is prevented from passing through the central bore and out of the ports; and on deactivation, fluid can pass through the central bore and is prevented from passing out of the ports.

5. A bottom hole assembly according to claim 3 wherein the jetting tool comprises:

a cylindrical outer body in which is located a mandrel, the mandrel having a first end arranged towards a first end of the outer body and a second extending from a second end of the outer body;

the first end of the outer body and the second end of the mandrel being configured for connection to drill pipe in a work string;

the mandrel being moveable within the outer body against a bias between a first position in which a first fluid flow path exists from the first end of the outer body to the second end of the mandrel through a central bore of the mandrel, and a second position in which flow through the central bore of the mandrel is prevented; wherein the outer body includes at least one radial port arranged through the outer body; and an obturating member is arranged within the outer body, the obturating member being moveable from an initial position in which a second fluid path exists from the first end of the outer body to an outer surface of the outer body via the at least one radial port, to a final position in which flow through the at least one radial port is prevented, and wherein the obturating member is moved from the initial position to the final position against the bias.

6. A bottom hole assembly according to claim 5 wherein the bias is a spring arranged between a lip on the inner surface of the outer body towards the second end of the outer body and a lip on the outer surface of the mandrel towards the first end of the mandrel.

7. A bottom hole assembly according to claim 5 wherein the mandrel includes a plug at the first end blocking the central bore, the plug having a sealing surface to contact a seat on an inner surface of the outer body.

8. A bottom hole assembly according to claim 7 wherein there are a plurality of apertures arranged through the mandrel at the first end adjacent the plug.

9. A bottom hole assembly according to claim 5 wherein the obturating member comprises a cylindrical body including one or more openings which when aligned with the at least one radial port allow fluid to pass to the outer surface of the outer body; a first latching mechanism at a first end to hold the obturating member against the outer body in the initial position until tension is applied to the work string; a second latching mechanism at a second end to hold the obturating member against the mandrel when tension is applied to move the obturating member from the initial position to the final position.

10. A bottom hole assembly according to claim 9 wherein there is a chamber between the second end of the obturating member and the outer body which is accessible via a relief port to the outer surface of the outer body.

11. A bottom hole assembly according to claim 1 wherein the bottom hole assembly includes a hydraulic jack.

12. A method of recovering inner casing located within outer casing from a wellbore in a single trip, comprising the steps:

(a) arranging a bottom hole assembly on a work string, the bottom hole assembly comprising:
- a spear for casing removal, the spear comprising an anchor mechanism configured to grip a section of the inner casing in the wellbore for removal thereof;
- a casing cutter having a cutting mechanism configured to cut the inner casing; and
- at least one first clean-up tool configured to remove material from inside the outer casing above the inner casing;

(b) running the work string in the well bore while operating one of the at least one first clean-up tools on the work string;

(c) removing material from inside the outer casing above the inner casing;

(d) operating the cutting mechanism to cut a section of the inner casing;

(e) gripping the section of the inner casing with the anchor mechanism; and (f) by raising the work string, removing the section of the inner casing from the wellbore;

and including the additional steps of:

(i) inserting a jetting tool in the bottom hole assembly;

(ii) on run-in, pumping fluid through a central bore of the jetting tool and radially out of ports to wash the inner surface of the outer casing;

(iii) activating the jetting tool by applying tension to the work string to prevent fluid from passing through the central bore and out of the ports; and (iv) deactivating the jetting tool by releasing tension on the work string to allow fluid to pass through the central bore and prevent fluid from passing out of the ports.

13. A method of recovering inner casing located within outer casing according to claim 12 wherein step (c) comprises one or more steps from the group consisting of: rotating a mill and abrading material on an inner surface of the outer casing; rotating a mill and abrading material at a top of the inner casing; and jetting fluid radially from ports in the work string to wash an inner surface of the outer casing.

14. A method of recovering inner casing located within outer casing according to claim 12 wherein fluid passing through the tool at step (b) is at a first pressure used to operate a second clean-up tool being a taper mill at a first end of the bottom hole assembly.

15. A method of recovering inner casing located within outer casing according to claim 14 wherein fluid passing through the tool at step (d) is increased to a second pressure to operate the cutting mechanism with cutting blades of the cutting mechanism being actuated to extend and cut at the second pressure, higher than the first pressure.

16. A method of recovering inner casing located within outer casing according to claim 12 wherein fluid passing through the tool is used to operate a downhole motor located above the cutting mechanism.

17. A method of recovering inner casing located within outer casing according to claim 12 wherein the method includes locating a hydraulic jack in the bottom hole assembly and operating the hydraulic jack by applying tension to the work string and activating the jetting tool.

* * * * *